US006136759A

United States Patent [19]

Takagi et al.

[11] Patent Number: 6,136,759

[45] Date of Patent: Oct. 24, 2000

[54] ADDITIVE COMPOSITION

[75] Inventors: Fumiaki Takagi; Kazuaki Abe, both of Sodegaura; Masami Yamanaka, Tokyo; Norihito Kanno; Katsumi Ichitani, both of Ichihara, all of Japan

[73] Assignee: Idemitsu Kosan Co., Ltd., Tokyo, Japan

[21] Appl. No.: 09/269,184

[22] PCT Filed: Jan. 20, 1999

[86] PCT No.: PCT/JP99/00182

§ 371 Date: Mar. 29, 1999

§ 102(e) Date: Mar. 29, 1999

[87] PCT Pub. No.: WO99/38939

PCT Pub. Date: Aug. 5, 1999

[30] Foreign Application Priority Data

Jan. 29, 1998 [JP] Japan ..... 10-016270

[51] Int. Cl.[7] ..... C10M 141/02; C10M 141/08; C10M 141/10

[52] U.S. Cl. ..... 508/272; 508/273; 508/436; 508/438; 508/442; 508/463; 508/465

[58] Field of Search ..... 508/485, 577, 508/273, 272, 436, 438, 442, 463, 465

[56] References Cited

U.S. PATENT DOCUMENTS

| | | | |
|---|---|---|---|
| 3,125,527 | 3/1964 | Krug et al. | 508/1 |
| 3,208,941 | 9/1965 | Owens | 508/577 |
| 3,884,995 | 5/1975 | Seiler | 508/485 |
| 4,664,825 | 5/1987 | Walsh | 508/485 |
| 6,008,168 | 12/1999 | Takagi et al. | 508/485 |

FOREIGN PATENT DOCUMENTS 62-266727A 11/1987 Japan .

*Primary Examiner*—Jacqueline V. Howard
*Attorney, Agent, or Firm*—Oblon, Spivak, McClelland, Maier & Neustadt, P.C.

[57] ABSTRACT

Provided is a novel additive composition containing (a) a compound having, in the molecule, a group of a general formula (I):

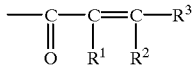

(I)

wherein $R^1$, $R^2$ and $R^3$ each represent a hydrogen atom or a methyl group, but at least one of $R^2$ and $R^3$ is a hydrogen atom, and (b) an extreme-pressure improver containing sulfur and/or phosphorus, and optionally, as an additional component (c), an extreme-pressure improver containing neither sulfur nor phosphorus. Lubricating oil compositions comprising the additive composition have high load carrying capacity, and are effectively used as metal working oils and hydraulic oils, such as forging oil, pressing oil, drawing oil, rolling oil, cutting oil, grinding oil, etc.

2 Claims, No Drawings

ADDITIVE COMPOSITION

This application is a 371 of PCT/SP99/00182 filed Jan. 20, 1999.

TECHNICAL FIELD

The present invention relates to a novel additive composition, and more precisely, to a novel additive composition having good load carrying capacity.

BACKGROUND OF THE INVENTION

Metal working oils such as forging oil, pressing oil, drawing oil, rolling oil, cutting oil, grinding oil and others comprise mineral oil, synthetic oil and/or hydrous oil (e.g., emulsion, solution, etc.), to which are added various oiliness agents and extreme-pressure agents as additives for the purpose of improving their working performance. Above all, the additives for forging oil are required to have load carrying capacity.

In internal-combustion engines, driving systems (automatic transmissions, buffers, power steering wheels, etc.), gears and others, used is lubricating oil for promoting their smooth operation. However, in the recent high-power and high-load situation for them, their lubricity is often unsatisfactory, thereby resulting in that the lubricative surface in them is exposed to much friction and worn whereby they may seize up. To evade the problem, therefore, various oiliness agents and extreme-pressure agents are added as additives to the lubricating oil for them. The additives are required to have good load carrying capacity. For meeting the requirement, various types of additives have heretofore been developed, but are still not fully satisfactory.

Recently, however, it has been said that some additives will have negative influences on the working environment and even on the natural environment. Therefore, it is desirable that the additives with that possibility are not used as much as possible. In particular, it is specifically said that additives containing chlorine or lead have negative influences on human bodies and the natural environment. In addition, it is said that zinc, molybdenum, alkali metals and alkaline earth metals will have the possibility of negative influences on the natural environment and the working environment.

The invention has been made in consideration of the matters noted above, and its object is to provide a novel additive composition having good load carrying capacity, in particular, to provide a novel additive composition having high load carrying capacity and having little possibility of negative influences on the working environment and the natural environment.

DISCLOSURE OF THE INVENTION

We, the present inventors have assiduously studied and, as a result, have found that a combination of an extreme-pressure improver that contains sulfur and/or phosphorus and an acrylate or methacrylate compound can effectively attain the object of the invention. On the basis of this finding, we have completed the invention. Specifically, the subject matter of the invention includes the following:

(1) A novel additive composition containing (a) a compound having, in the molecule, a group of a general formula (I):

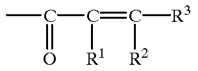

(I)

wherein $R^1$, $R^2$ and $R^3$ each represent a hydrogen atom or a methyl group, but at least one of $R^2$ and $R^3$ is a hydrogen atom, and (b) an extreme-pressure improver containing sulfur and/or phosphorus.

(2) The novel additive composition which further contains, as an additional component (c), an extreme-pressure improver containing neither sulfur nor phosphorus.

(3) The novel additive composition of (1) or (2), wherein the component (b) does not contain a halogen compound.

(4) The novel additive composition of any one of (1) to (3), wherein the component (b) does not contain a lead compound.

(5) The novel additive composition of any one of (2) to (4), wherein the component (c) does not contain a halogen compound.

(6) The novel additive composition of any one of (2) to (5), wherein the component (c) does not contain a lead compound.

(7) The novel additive composition of any one of (1) to (6), wherein the component (b) does not contain a metal compound.

(8) The novel additive composition of any one of (2) to (7), wherein the component (c) does not contain ametal compound.

BEST MODES FOR CARRYING OUT THE INVENTION

Embodiments of the invention are described below.

The compound of the component (a) that constitutes the invention has, in the molecule, a group of a general formula (I):

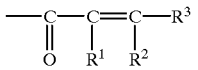

(I)

In formula (I), $R^1$, $R^2$ and $R^3$ each represent a hydrogen atom or a methyl group, but at least one of $R^2$ and $R^3$ is a hydrogen atom. The compound may have one group of formula (I) or a plurality of the groups.

Examples of the compound having the group of formula (I) include polyethylene glycol diacrylate; polyethylene glycol dimethacrylate; caprolactone-modified hydroxypivalic acid neopentyl glycol ester diacrylate; caprolactone-modified hydroxypivalic acid neopentyl glycol ester dimethacrylate; 2,2-bis(4-ethyleneglycoxyphenyl)propane diacrylate; 2,2-bis(4-ethyleneglycoxyphenyl)propane dimethacrylate; 2,2-bis(4-polyethyleneglycoxyphenyl) propane diacrylate; 2,2-bis(4-polyethyleneglycoxyphenyl) propane dimethacrylate; tris(propylene glycol acrylate) glycerin ether; tris(polypropylene glycol acrylate) glycerin ether; trimethylolpropane (ethylene glycol acrylate) ether; trimethylolpropane (polyethylene glycol acrylate) ether; trimethylolpropane (ethylene glycol methacrylate) ether; trimethylolpropane (polyethylene glycol methacrylate) ether; dipentaerythritol acrylate; dipentaerythritol methacrylate; caprolactone-modified dipentaerythritol acrylate; caprolactone-modified dipentaerythritol methacrylate; pentaerythritol (isostearate, 2-ethylhexanoate, diacrylate); dipentaerythritol (trinonanoate, triacrylate), etc. Of those, preferred are pentaerythritol (isostearate, 2-ethylhexanoate, diacrylate), dipentaerythritol (trinonanoate, triacrylate), etc., in view of their ability to improve working performance.

In the invention, one or more such compounds may be used for the component (a) either singly or as combined.

Of the component (b) that constitutes the invention, the sulfur-containing extreme-pressure improver is not specifically defined, provided that it contains at least one sulfur atom in the molecule and can dissolve or uniformly disperse in the base oil of lubricating oil to exhibit its extreme-pressure improving effect. It includes, for example, sulfurized oils and fats, sulfurized mineral oils, sulfurized fatty acids, sulfurized esters, sulfurized olefins, dihydrocarbyl polysulfides, thiadiazole compounds, alkylthiocarbamoyl compounds, thioterpene compounds, dialkylthio dipropionate compounds, etc. The sulfurized oils and fats are obtained by reacting sulfur or a sulfur-containing compounds with oils and fats (lard oil, whale oil, vegetable oil, fish oil, etc.), and their sulfur content is not specifically defined. In general, however, preferred are those having a sulfur content of from 5 to 30% by weight. Their specific examples include sulfurized lard, sulfurized rapeseed oil, sulfurized castor oil, sulfurized soybean oil, sulfurized rice bran oil, etc. Examples of the sulfurized fatty acids include sulfurized oleic acid, etc.; those of the sulfurized esters include sulfurized methyl oleate, sulfurized octyl esters of rice bran fatty acids, etc.

The sulfurized olefins include, for example, compounds of the following general formula (II), etc.

$$R^4\text{-}S_a\text{-}R^5 \quad \text{(II)}$$

wherein $R^4$ represents an alkenyl group having from 2 to 15 carbon atoms; $R^5$ represents an alkyl or alkenyl group having from 2 to 15 carbon atoms; and a represents an integer of from 1 to 8.

The compounds are obtained by reacting an olefin having from 2 to 15 carbon atoms or its di- to tetra-mer with a sulfurizing agent such as sulfur, sulfur chloride or the like. As the olefin, preferred are propylene, isobutene, diisobutene, etc.

The dihydrocarbyl polysulfides are compounds of a general formula (III):

$$R^6\text{-}S_bR^7 \quad \text{(III)}$$

wherein $R^6$ and $R^7$ each represent an alkyl or cyclic alkyl group having from 1 to 20 carbon atoms, an aryl group having from 6 to 20 carbon atoms, an alkylaryl group having from 7 to 20 carbon atoms, or an arylalkyl group having from 7 to 20 carbon atoms, and they may be the same or different; and b represents an integer of from 2 to 8.

The compound of formula (III) where $R^6$ and $R^7$ are alkyl groups are referred to as alkyl sulfides.

Specific examples of $R^6$ and $R^7$ in formula (III) include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various dodecyl groups, a cyclohexyl group, a cyclooctyl group, a phenyl group, a naphthyl group, a tolyl group, a xylyl group, a benzyl group, a phenethyl group, etc.

As preferred examples of the dihydrocarbyl polysulfides, mentioned are dibenzyl polysulfides, various dinonyl polysulfides, various didodecyl polysulfides, various dibutyl polysulfides, various dioctyl polysulfides, diphenyl polysulfides, dicyclohexyl polysulfides, etc.

As the thiadiazole compounds, for example, preferably used are 1,3,4-thiadiazoles and 1,2,4-thiadiazoles of general formulae (IV):

(IV)

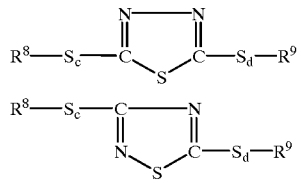

wherein $R^8$ and $R^9$ each represent a hydrogen atom, or a hydrocarbon group having from 1 to 20 carbon atoms; and c and d each represent an integer of from 0 to 8.

Specific examples of the thiadiazole compounds include 2,5-bis(n-hexyldithio)-1,3,4-thiadiazole, 2,5-bis(n-octyldithio)-1,3,4-thiadiazole, 2,5-bis(n-nonyldithio)- 1,3,4-thiadiazole, 2,5-bis(1,1,3,3-tetramethylbutyldithio)-1,3,4-thiadiazole, 3,5-bis (n-hexyldithio)-1,2,4-thiadiazole, 3,5-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, etc., and these are preferably used in the invention.

As the alkylthiocarbamoyl compounds, for example, used are those of a general formula (V):

(V)

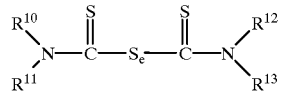

wherein $R^{10}$ to $R^{13}$ each represent an alkyl group having from 1 to 20 carbon atoms; and e represents an integer of from 1 to 8.

Specific examples of the alkylthiocarbamoyl compounds include bis(dimethylthiocarbamoyl) monosulfide, bis(dibutylthiocarbamoyl) monosulfide, bis(dimethylthiocarbamoyl) disulfide, bis(dibutylthiocarbamoyl) disulfide, bis(diamylthiocarbamoyl) disulfide, bis(dioctylthiocarbamoyl) disulfide, etc., and these are preferably used in the invention.

The thioterpene compounds include, for example, reaction products of phosphorus pentasulfide and pinene; and the dialkylthio dipropionate compounds include, for example, dilaurylthio dipropionate, distearylthio dipropionate, etc. Of those, preferred are dihydrocarbyl polysulfides, as exhibiting good extreme-pressure improving characteristics.

Extreme-pressure improvers containing sulfur and metal could be used in the invention, which include, for example, zinc dialkyldithiocarbamates (Zn-DTC), molybdenum dialkyldithiocarbamates (Mo-DTC), lead dialkyldithiocarbamates, tin dialkyldithiocarbamates, sodium sulfonates, calcium sulfonates, etc. However, these are unfavorable for environmental protection.

In the invention, one or more such sulfur-containing extreme-pressure improvers may be used for the component (b) either singly or as combined.

Of the component (b) that constitutes the invention, the phosphorus-containing extreme-pressure improver is not specifically defined, provided that it contains at least one phosphorus atom in the molecule and can dissolve or uniformly disperse in the base oil of lubricating oil to exhibit its extreme-pressure improving effect. Its specific examples are phosphate analogues and their amine salts.

The phosphate analogues include phosphates, acid phosphates, phosphites and acid phosphites of general formulae (VI) to (X):

(VI)

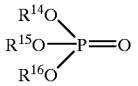

(VII)

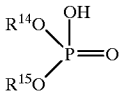

(VIII)

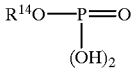

(IX)

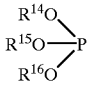

(X)

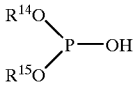

In formulae (VI) to (X), $R^{14}$ to $R^{16}$ each represent an alkyl, alkenyl, alkylaryl or arylalkyl group having from 4 to 30 carbon atoms, and $R^{14}$ to $R^{16}$ may be the same or different.

The phosphates include triaryl phosphates, trialkyl phosphates, trialkylaryl phosphates, triarylalkyl phosphates, trialkenyl phosphates, etc. As their specific examples, mentioned are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, trioleyl phosphate, etc.

Specific examples of the acid phosphates include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, isostearyl acid phosphate, etc.

Specific examples of the phosphites include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, trioleyl phosphite, etc.

Specific examples of the acid phosphites include dibutyl hydrogenphosphite, dilauryl hydrogenphosphite, dioleyl hydrogenphosphite, distearyl hydrogenphosphite, diphenyl hydrogenphosphite, etc.

Of the phosphate analogues noted above, preferred are oleyl acid phosphate and stearyl acid phosphate.

Amines that form amine salts with the phosphate analogues include, for example, mono-substituted amines, di-substituted amines and tri-substituted amines of a general formula (XI)

$$R^{17}{}_{n}NH_{3-n} \qquad (XI)$$

wherein $R^{17}$ represents an alkyl or alkenyl group having from 3 to 30 carbon atoms, an aryl or arylalkyl group having from 6 to 30 carbon atoms, or a hydroxyalkyl group having from 2 to 30 carbon atoms; n represents 1, 2 or 3; and plural $R^{17}$'s, if any, may be the same or different.

The alkyl or alkenyl group having from 3 to 30 carbon atoms for $R^{17}$ in formula (XI) may be linear, branched or cyclic.

Examples of the mono-substituted amines include butylamine, pentylamine, hexylamine, cyclohexylamine, octylamine, laurylamine, stearylamine, oleylamine, benzylamine, etc.; and those of the di-substituted amines include dibutylamine, dipentylamine, dihexylamine, dicyclohexylamine, dioctylamine, dilaurylamine, distearylamine, dioleylamine, dibenzylamine, stearylmonoethanolamine, decyl-monoethalnolamine, hexylmonopropanolamine, benzyl-monoethanolamine, phenylmonoethanolamine, tolyl-monopropanolamine, etc. Examples of the tri-substituted amines include tributylamine, tripentylamine, trihexylamine, tricyclohexylamine, trioctylamine, trilaurylamine, tristearylamine, trioleylamine, tribenzylamine, dioleylmonoethanolamine, dilauryl-monopropanolamine, dioctylmonoethanolamine, dihexyl-monopropanolamine, dibutylmonopropanolamine, oleyl-diethanolamine, stearyldipropanolamine, lauryl-diethanolamine, octyldipropanolamine, butyl-diethanolamine, benzyldiethanolamine, phenyl-diethanolamine, tolyldipropanolamine, xylyl-diethanolamine, triethanolamine, tripropanolamine, etc.

As examples of compounds containing both sulfur and phosphorus, mentioned are phosphosulfurized oils and fats, phosphosulfurized olefins, etc. Naturally, these are usable as the component (b) in the invention.

As examples of compounds containing phosphorus and halogen atoms, mentioned are chlorinated phosphates; and as those containing sulfur, phosphorus and metal, mentioned are zinc dialkyldithiophosphates (Zn-DTP), molybdenum dialkyldithiophosphates (Mo-DTP), lead dialkyldithiophosphates, tin dialkyldithiophosphates, etc. These could be used as the component (b) in the invention, but are unfavorable for environmental protection.

In the composition of the invention, the components (a) and (b) maybe in any ratio. Preferably, however, the component (a) is in an amount of from 1 to 99% by weight and the component (b) is in an amount of from 1 to 99% by weight, based on the total of the components (a) and (b). More preferably, the component (a) is in an amount of from 10 to 90% by weight and the component (b) is in an amount of from 10 to 90% by weight. If the amount of the component (a) or (b) in the composition is smaller than 1% by weight or larger than 99% by weight, the composition could not satisfactorily exhibit its extreme-pressure improving effect. Owing to the synergistic effect of the components (a) and (b), the extreme-pressure improving effect of the composition is higher than that of single component (a) or (b).

Adding the component (c) to the composition enhances the effect of the composition. The component (c) is an extreme-pressure improver containing neither sulfur nor phosphorus, and includes compounds containing neither sulfur nor phosphorus. As examples of the component (c), mentioned are boron compounds such as tribenzyl borate, etc.; fatty oils such as animal oils, ester oils (butyl stearate, oleic acid monoglyceride, etc.), etc.; fatty acids such as oleic acid, stearic acid, etc.; alcohols such as oleyl alcohol, lauryl alcohol, etc.; amine compounds such as cetylamine, etc. Of those compounds, preferred are ester oils, fatty acids, alcohols, etc. As halogen atom-containing compounds, mentioned are halogen compounds such as chlorinated paraffins, chlorinated fatty oils, diphenyl chlorides, chlorinated carboxylic acid derivatives, silicone iodides, benzyl iodides, polybutene iodides, silicone fluorides, fluorinated fatty acids, etc., and as metal-containing compounds, mentioned are lead compounds such as lead naphthenate, lead oleate, etc.; zinc compounds such as zinc acrylate, etc.; iron compounds such as iron oleate, etc.; alkali metal compounds such as sodium carbonate, etc.; alkaline earth metal compounds such as calcium carbonate, etc. These compounds could be used as the component (c) in the invention, but are unfavorable for environmental protection.

The amount of the component (c) that may be in the composition of the invention is any desired one, but is preferably from 1 to 500% by weight based on the total of the components (a) and (b). More preferably, it is from 1 to 300% by weight. If its amount in the composition is smaller than 1% by weight, the component (c) could not satisfactorily exhibit its effect. However, if larger than 500% by weight, the component (c) will interfere with the effect of the components (a) and (b).

In general, the additive composition of the invention may contain various known additives usable in lubricating oil, such as antioxidant, rust inhibitor, pour point depressant, viscosity index improver, detergent dispersant, metal inactivator, oily agent, emulsifier, etc., within the range not interfering with the object of the invention.

Singly or as combined with base oil (mineral oil, synthetic oil), the additive composition of the invention is used as various oiliness agents. If desired, surfactant, microbicide, preservative and others may be added to the additive composition of the invention, and emulsified in water before use.

The mineral oil and synthetic oil are not specifically defined, and may be any ordinary ones generally used as the base oil for lubricating oil and metal working oil. However, preferred are those having a kinematic viscosity at 40° C. of from 1 to 5,000 $mm^2$/sec, more preferably from 3 to 3,000 $mm^2$/sec. If their viscosity oversteps the preferred range, their properties may be poor, and, in addition, they may be difficult to handle. The pour point of the base oil, which is the index for the low-temperature fluidity thereof, is not specifically defined, but is preferably not higher than −10° C. so that it could be usable even at low temperatures.

Various types of such mineral oil and synthetic oil are known, and may be suitably selected depending on their use. The mineral oil includes, for example, distillate oils as obtained through normal pressure distillation of paraffin base crude oils, intermediate base crude oils or naphthene base crude oils, those as obtained through reduced pressure distillation of the oily residues from such normal pressure distillation, as well as purified oils as obtained through purification of those distillate oils, such as solvent-purified oils, hydrogenation-purified oils, dewaxed oils, clay-processed oils, etc.

The synthetic oil includes, for example, poly-a-olefins, a-olefin copolymers, polybutenes, alkylbenzenes, polyol-esters, esters of dibasic acids, polyoxyalkylene glycols, esters of polyoxyalkylene glycols, polyalkylene glycol ethers, silicone oils, etc.

These base oils can be used either singly or as combined. As the case may be, mineral oils and synthetic oils can be combined for use in the invention. The preferred amount of the additive composition of the invention to be added to base oil falls between 0.1 and 300 parts by weight relative to 100 parts by weight of base oil. If its amount is too small, the composition could not exhibit its effect; but even if too large, its effect could no more be augmented. More preferably, the amount falls between 0.5 and 100 parts by weight.

EXAMPLES

The invention is described in more detail with reference to the following Examples, which, however, are not whatsoever intended to restrict the scope of the invention.

Examples 1 to 6, and Comparative Examples 1 to 4

The additive shown in Table 1 was added to mineral oil in the amount (parts by weight) indicated in Table 1 to prepare lubricating oil compositions of Examples and Comparative Examples. The compositions were evaluated for the load carrying capacity, according to the Japanese Petroleum Industry Standard (JPI-5S-40-93). Precisely, they were tested, using a Shell four-ball friction tester for which the number of revolutions was 1800 rpm, the temperature was 25° C. and the test period was 10 second, and the Welding Load measured indicates the load carrying capacity of each sample tested. The test data obtained are shown in Table 1.

TABLE 1-1

| Example | 1 | 2 | 3 | 4 | 5 | 6 | 7 | 8 | 9 | 10 | 11 | 12 |
|---|---|---|---|---|---|---|---|---|---|---|---|---|
| Mineral Oil (*1) | 100 | 100 | 100 | 100 | 100 | 100 | — | 100 | 100 | 100 | 100 | 100 |
| Polysulfide (*2) | 5 | 5 | — | — | 5 | 5 | 100 | 27 | 10 | 10 | 10 | 10 |
| Phosphate (*3) | — | — | 5 | 5 | 5 | 5 | — | — | — | — | — | — |
| Acrylate 1 (*4) | 10 | — | 10 | — | 10 | — | 496 | 42 | 10 | 10 | 10 | 10 |
| Acrylate 2 (*5) | — | 10 | — | 10 | — | 10 | — | — | — | — | — | — |
| Fatty Acid Ester (*6) | — | — | — | — | — | — | — | — | — | 5 | — | — |
| Zn-DTP | — | — | — | — | — | — | — | — | — | — | 5 | — |
| Perbasic Calcium Sulfonate | — | — | — | — | — | — | — | — | — | — | — | 5 |
| Welding Load (kgf) | 620 | 620 | 620 | 620 | 800< | 800< | 800< | 800< | 620 | 800< | 800< | 800< |

TABLE 1-2

| Comparative Example | 1 | 2 | 3 | 4 |
|---|---|---|---|---|
| Mineral Oil (*1) | 100 | 100 | 100 | 100 |
| Polysulfide (*2) | 5 | — | — | — |

TABLE 1-2-continued

| Comparative Example | 1 | 2 | 3 | 4 |
|---|---|---|---|---|
| Phosphate (*3) | — | 5 | — | — |
| Acrylate 1 (*4) | — | — | 10 | — |
| Acrylate 2 (*5) | — | — | — | 10 |
| Welding Load (kgf) | 400 | 315 | 160 | 200 |

(Notes)
*1: Paraffin-based mineral oil (kinematic viscosity at 40° C., 28 $mm^2$/sec)
*2: Di-tert-dodecyl polysulfide
*3: Oleyl acid phosphate
*4: Pentaerythritol (isostearate, 2-ethylhexanoate, diacrylate)
*5: Dipentaerythritol (trinonanoate, triacrylate)
*6: Copolymer of dioctyl maleate and $C_{10}$ a-olefin

INDUSTRIAL APPLICABILITY

Lubricating oil compositions comprising the additive composition of the invention have high load carrying capacity, and are effectively used as metal working oils and hydraulic oils, such as forging oil, pressing oil, drawing oil, rolling oil, cutting oil, grinding oil, etc.

What is claimed is:

1. An oil additive composition, comprising:

(a) a compound having, in the molecule, a group of a general formula (I):

(I)

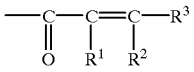

wherein $R^1$, $R^2$ and $R^3$ each represent a hydrogen atom or a methyl group, but at least one of $R^2$ and $R^3$ is a hydrogen atom, and (b) at least one extreme-pressure improver containing sulfur, selected from the group consisting of sulfurized olefins of formula (II), $$R^4\text{-}S_a\text{-}R^5 \quad \text{(II)}$$

wherein $R^4$ is an alkenyl group having from 2 to 15 carbon atoms, $R^5$ is an alkyl or alkenyl group having from 2 to 15 carbon atoms, and "a" represents an integer from 1 to 8;

dihydrocarbyl polysulfides of formula (III):

$$R^6\text{-}S_b\text{-}R^7 \quad \text{(III)}$$

wherein $R^6$ and $R^7$ each independently represents an alkyl or cyclic alkyl group having 1 to 20 carbon atoms, an aryl group having 6 to 20 carbon atoms, an alkylaryl group having 7 to 20 carbon atoms, or an arylalkyl group having 7 to 20 carbon atoms, and "b" is an integer from 2 to 8;

thiadiazole compounds of the following formulae (IV):

(IV)

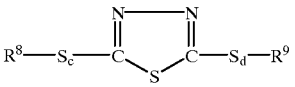

-continued

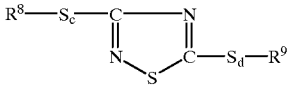

wherein $R^8$ and $R^9$ each represent a hydrogen atom, or a hydrocarbon group having 1 to 20 carbon atoms; and "c" and "d" each represent an integer from 0 to 8, and alkylthiocarbamoyl compounds of formula (V):

(V)

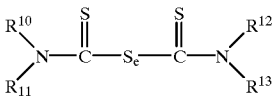

wherein $R^{10}$ and $R^{13}$ each represent an alkyl group having 1 to 20 carbon atoms; and "e" represents an integer from 1 to 8, and an extreme-pressure improver containing phosphorus selected from the group consisting of formulae (VI) to (X):

(VI)

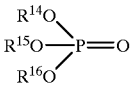

(VII)

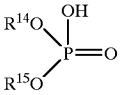

(VIII)

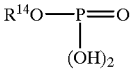

(IX)

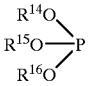

(X)

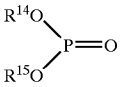

wherein $R^{14}$ to $R^{16}$ each represent an alkyl, alkenyl, alkylaryl or arylalkyl group having 4 to 30 carbon atoms, and $R^{14}$ to $R^{16}$ may be the same or different; and component (a) is present in an amount of 1 to 99% by weight and component (b) is present in an amount of 1 to 99% by weight, based on the total amount of components (a) and (b).

2. The oil additive of claim 1, further comprising component (c), which is an extreme-pressure improver containing neither sulfur nor phosphorus, wherein the amount of component (c) is from 1 to 300% by weight based on the total amount of components (a) and (b).

* * * * *